United States Patent [19]

Hillstrom

[11] Patent Number: 4,730,803

[45] Date of Patent: Mar. 15, 1988

[54] GROUND ACCESS ELEVATED POLE BANNER

[75] Inventor: David U. Hillstrom, Novi, Mich.

[73] Assignee: Marketing Displays, Inc., Farmington Hills, Mich.

[21] Appl. No.: 905,774

[22] Filed: Sep. 10, 1986

[51] Int. Cl.[4] ..... A47F 5/00

[52] U.S. Cl. ..... 248/297.2; 248/286; 248/231; 248/219.4; 40/607

[58] Field of Search ..... 248/297.2, 297.3, 219.4, 248/218.4, 125, 293, 286, 219.1, 219.3, 231; 40/607, 606; 182/91

[56] References Cited

U.S. PATENT DOCUMENTS

| | | | |
|---|---|---|---|
| 321,887 | 7/1885 | Cross | 248/297.3 X |
| 2,362,092 | 11/1944 | Phelps . | |
| 2,484,349 | 10/1949 | Kelly . | |
| 2,736,100 | 2/1956 | Landau | 248/297.2 X |
| 2,911,746 | 11/1959 | Frey . | |
| 3,082,989 | 3/1963 | Bower . | |
| 3,089,268 | 5/1963 | Frey et al. . | |
| 3,102,353 | 9/1963 | Kies . | |
| 3,241,800 | 3/1966 | Richter, III | 248/231 X |
| 3,263,356 | 8/1966 | Gilmoure et al. . | |
| 3,288,412 | 11/1966 | Murphy . | |
| 3,477,158 | 11/1969 | Chandos . | |
| 3,537,201 | 11/1970 | Huey et al. . | |
| 3,593,450 | 7/1971 | Mollet, III et al. . | |
| 3,609,894 | 10/1971 | Miller, III . | |
| 3,850,401 | 11/1974 | Snediker | 248/291 |
| 4,029,355 | 6/1977 | Wilhelmsen | 182/91 X |
| 4,089,129 | 5/1978 | Patterson, Jr. . | |
| 4,105,190 | 8/1978 | Curtis . | |
| 4,139,101 | 2/1979 | Towligh | 248/293 X |
| 4,250,647 | 2/1981 | Woodard | 248/297.3 X |
| 4,525,946 | 7/1985 | Olson . | |

*Primary Examiner*—Reinaldo P. Machado
*Assistant Examiner*—Alvin Chin-Shue
*Attorney, Agent, or Firm*—Harness, Dickey & Pierce

[57] ABSTRACT

The present invention discloses a lightweight sign-support assembly for displaying and supporting a sign in a preselected display position. The sign-supporting assembly is especially adapted for ground-access removal, installation, or changing of signs or messages in elevated pole banner-type signs. The sign supporting assembly includes a track secured to a pole, a support assembly slidably secured in the track, and a locking mechanism for positioning and releasably securing the support assembly along the track.

18 Claims, 10 Drawing Figures

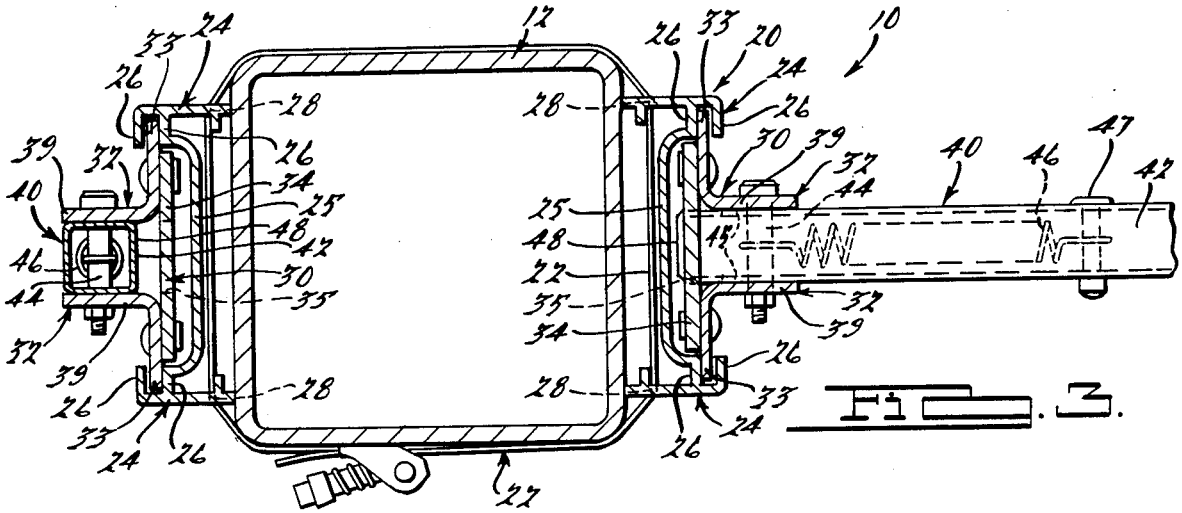
FIG. 3.
FIG. 4.
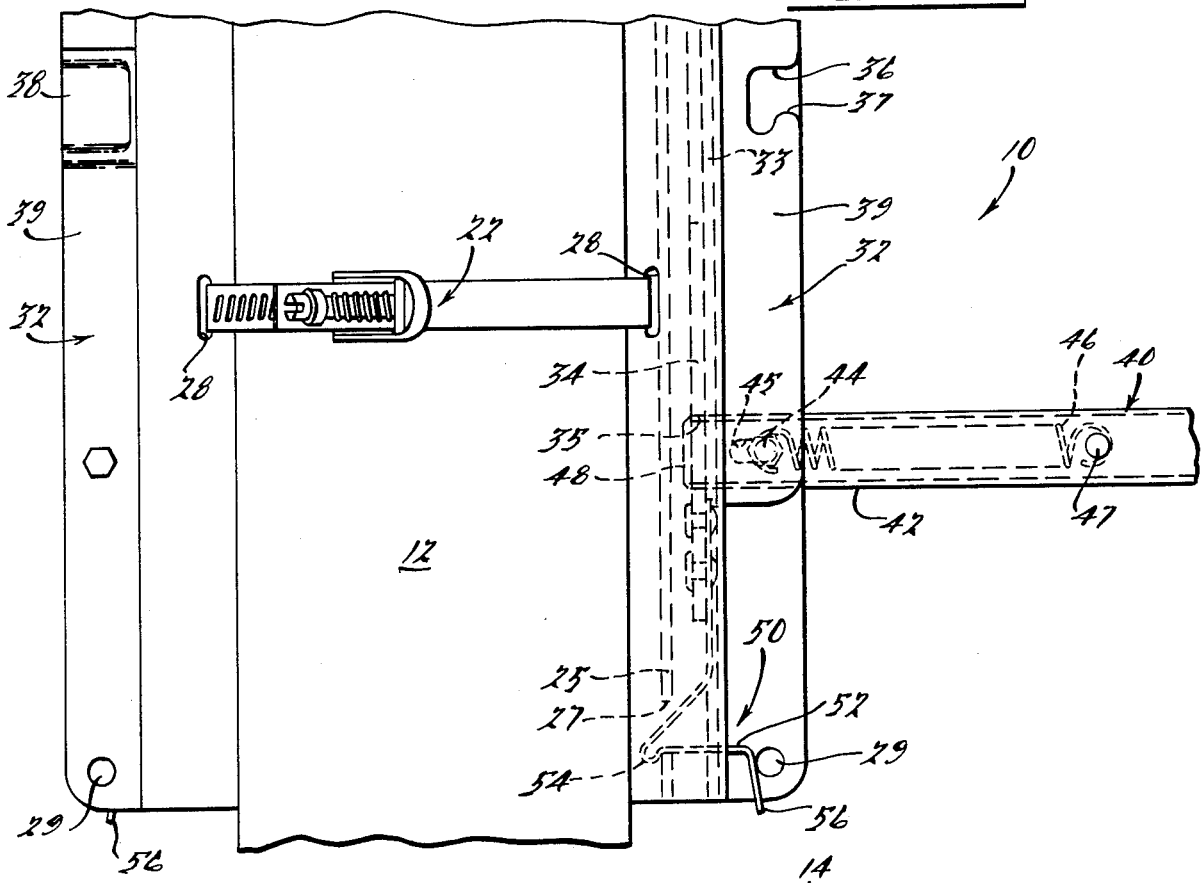
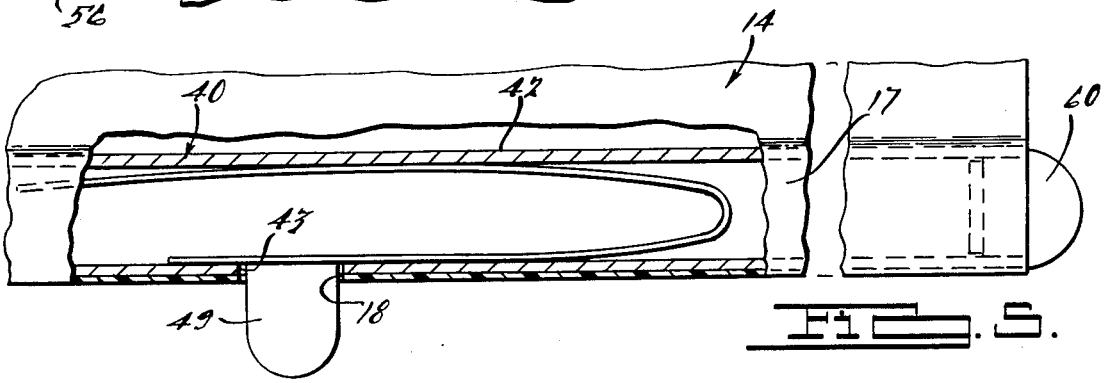
FIG. 5.

GROUND ACCESS ELEVATED POLE BANNER

BACKGROUND AND SUMMARY OF THE INVENTION

The present invention relates generally to a device for supporting and displaying a sign, and more particularly to such a device movably positioning and supporting a sign at a preselected display position on the surface of an object, such as for supporting a banner-type sign at an elevated position on a generally vertical pole, for example.

Merchants and others displaying advertisements or other messages have frequently used billboards, electric signs, free-standing signs, elevated or overhead signs, or combinations of these types of signs, to effectively convey their messages to passersby. Frequently such signs have been of a heavy construction suitable for withstanding the prevailing conditions in outdoor applications. Such heavy duty constructions, while enabling these types of signs to endure adverse wind and other weather conditions, have frequently been found to be unattractive, bulky to handle, expensive to purchase and maintain, or inconvenient to change. These effects are usually even more pronounced in elevated pole banner signs.

The present invention seeks to overcome the above-discussed drawbacks in previous sign-supporting devices by providing an attractive, lightweight and inexpensive device for supporting and displaying a sign t a preselected display position on the surface of an object, such as on a generally vertical pole in an elevated banner-type sign for example. In doing so, the present invention provides such a sign-supporting device that is highly visible, weather-resistant, and that provides for ease, safety and convenience when the sign is to be changed or replaced. Accordingly, a sign-supporting device according to the present invention is particularly well-suited for application in a ground access elevated pole banner.

According to the present invention, the sign-supporting device includes a track mechanism, means for securing the track mechanism to the surface of an object, such as a generally vertical mounting pole for example, a support mechanism slidably movable on the track mechanism for supporting the sign thereon and for allowing the sign to be moved to and from the preselected display position, and a locking mechanism for releasably locking and maintaining the supporting mechanism and the sign at such preselected positions. Preferably, the sign-supporting device according to the present invention further provides for the sign to be removably attached to the supporting mechanism. In order to conveniently accomplish such sign changing or replacement, the supporting mechanism is preferably removably interconnected with the track mechanism in order to allow the sign to be attached to, or removed from, the supporting mechanism apart from the track mechanism.

In a preferred embodiment of the invention, the movable supporting mechanism includes a slider member slidably interconnected with the track mechanism, with a support arm interconnected with the slider member for pivotal movement between an extended position protruding outwardly relative to the track mechanism and a retracted position generally adjacent to, or aligned with, the track mechanism. The preferred track mechanism and slider member also preferably include provisions for releasably locking or securing the pivotal support arm in either of its extended or retracted positions.

Additional objects, advantages, and features of the present invention will become apparent from the following description and appended claims, taken in conjunction with the accompanying drawings.

BRIEF DESCRIPTION OF THE DRAWINGS

FIG. 3 is a cross-sectional view, taken generally along line 3—3 of FIG. 1, but with a portion of the sign-supporting device shown in a retracted position.

FIG. 4 is an enlarged, partial front elevational view of the sign-supporting portion of the assembly shown in FIG. 1.

FIG. 5 is an enlarged detailed view, with portions broken away, of a sign-supporting arm of FIG. 1, illustrating the mechanism by which a sign is attached and removably secured thereto.

DETAILED DESCRIPTION OF THE PREFERRED EMBODIMENTS

FIGS. 1 through 10 illustrate various exemplary embodiments of a sign and sign-supporting device according to the present invention, as applied in a ground access pole banner application. One skilled in the art will readily recognize from the following discussion, taken in conjunction with the accompanying claims and drawing figures, that the present invention is equally applicable to other types of applications for supporting and displaying a sign, including such applications where the sign is displayed other than in an elevated vertical orientation.

Figure 1:
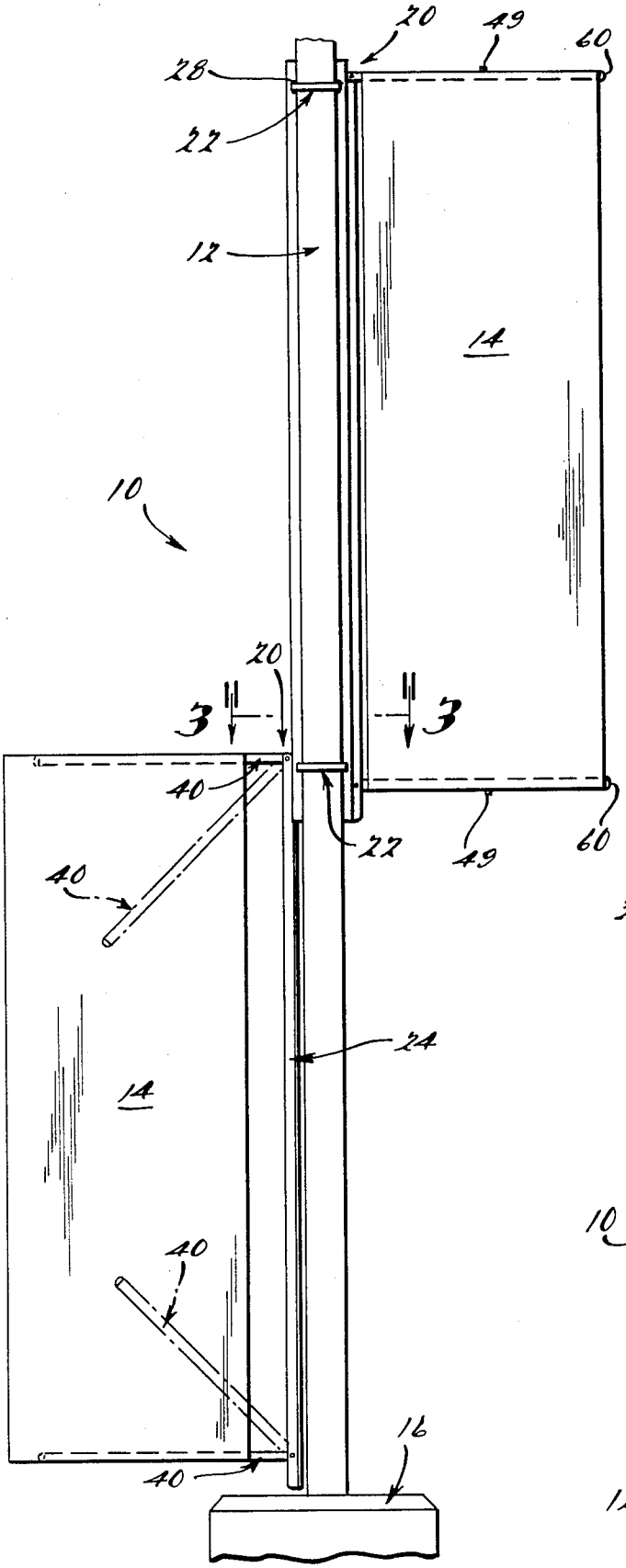
FIG. 1 is a front elevational view of an exemplary sign and sign-supporting assembly in accordance with the present invention.

In FIG. 1, an exemplary sign-supporting device 10 according to the present invention is mounted on a vertical pole 12 for supporting and displaying one or more signs 14 in an elevated position and in a vertical orientation relative to a base 16 or other underlying surface or object. The sign-supporting device 10 generally includes a track or track assembly 20, a slider assembly 30, a support arm assembly 40, and a locking apparatus 50.

The track assembly 20 can be secured to the surface of the pole 12 by way of one or more clamps 22 clamping surrounding the pole 12 and extending through a number of openings 28 in the track assembly 20. The preferred track assembly 20 includes a pair of elongated channels 24 spaced laterally apart from one another, with each channel 24 having a pair of legs 26 protruding therefrom, with the legs 26 on adjacent channels 24 extending in opposite lateral directions toward one another. It should be noted that although a band-type clamp 22 is shown for purposes of illustration in the drawings, any of a number of suitable clamping or mounting apparatuses can alternately be used for securing the track assembly 20 to the pole 12.

Preferably, one of the channels 24 of the track assembly 20 is longer than the other, and extends downwardly beneath the lower end of the other channel 24, for purposes of facilitating and guiding the insertion of the slider assembly 30 between the channels 24 during interconnection of the slider and support assemblies 30 and 40 with the track assembly 20. The track assembly 20 also preferably includes a track base plate 25 interconnecting the channel members 24 in their laterally spaced-apart position, as well as a track opening 27, or other such discontinuity, in the track base plate 25 for operative cooperation with the locking apparatus 50 as is described in more detail below.

The preferred slider assembly 30 includes a pair of slider members 32 spaced laterally apart from one another and an inner base formed by the base portions 33 and a slider plate member 34, with the plate member 34 interconnecting the base portions 33, and preferably with a pair of outer flange portions 39 protruding outwardly from the inner base. The slider members 32 are interconnected with the support arm assembly 40 and have the base portions 33 slidably received between the legs 26 of the channels 24 for sliding movement along the track assembly 20 to and from a preselected display position for the sign 14, as shown on the right-hand side of the pole 12 in FIG. 1.

Figure 2:
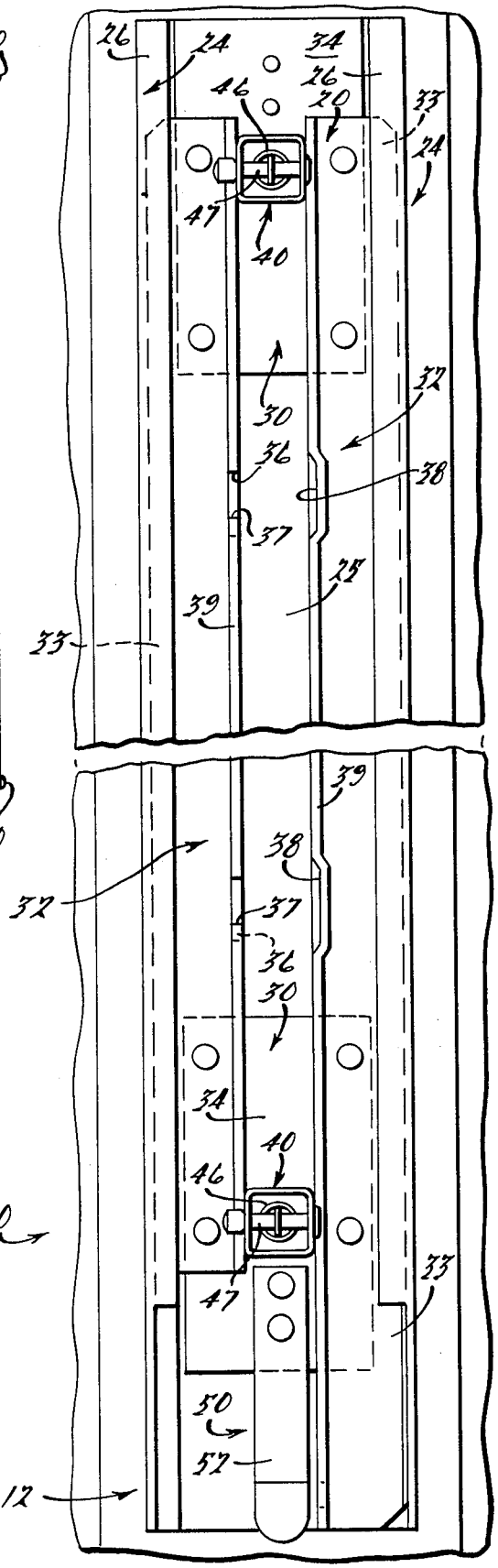
FIG. 2 is an enlarged, partial side elevational view of the sign-supporting portion of the assembly shown in FIG. 1.

The support arm assemblies 40 preferably each include a support arm member 42 pivotally interconnected with the slider members 32 by way of a pivot pin 44, with the pivot pin 44 being interconnected with the slider members 32 at a fixed position thereon and received within an elongated opening 45 in each of the support arms 42. A biasing spring 46 is provided within the preferably hollow tubular support arms 42, with one end of the biasing spring anchored to the pivot pin 44, and the opposite end of the biasing spring 46 anchored on a spring anchoring pin 47 extending through the support arm 42. Such an arrangement, with the elongated shape of the elongated openings 45, results in the support arms 42 being interconnected for limited movement toward and away from their respective pivot pins 44, with the biasing springs 46 and resiliently biasing the support arms 42 toward their respective pivot pins 44. Thus, when the support arms 42 are pivoted relative to their respective slider members 32 to their extended positions as shown in FIGS. 1 and 2, and in the right-hand side of FIGS. 3 and 4, the inner ends 48 of the support arms 42 are received within correspondingly located openings or other such discontinuities 35 in the slider plate members 34 and resiliently biased by the biasing spring 46 into an interlocking engagement therewith. In this regard, in order to facilitate the entry of the ends 48 of the support arms 42 into the openings 35 in the slider plates 34, the inner ends 48 are preferably chamfered, tapered, or radiused.

Similarly, support arms 42 are releasably securable in their respective retracted positions, wherein they are substantially concealed from view between the flange portions 39 of the slider members 32. To accomplish this, corresponding openings 36 are formed within the flange portions 39, with each of the openings 36 having a cam surface 37 at its outer end. Thus, as the support arms 42 are pivoted to their respective retracted positions, as shown on the left-hand side of FIGS. 3 and 4, one end of each spring anchoring pins 47 is received within the corresponding opening 36, and slidably engages the cam surface 37 therein in order to urge the support arm 42 outwardly relative to its pivot pin 44. Once the support arms 42 have been fully retracted such that their anchoring pins 47 slidably pass inwardly of the cam surfaces 37, the biasing springs 36 biasingly urge the support arms 42 in a direction toward the pivot pins 44, thereby releasably and interlockingly securing the support arms 42 in their retracted positions. It should be noted that the cam surfaces 37 are preferably configured such that when the support arms 42 are pivoted outwardly from their retracted positions toward their extended positions, the anchoring pins 47 easily slide over the cam surfaces 37 in order to allow the support arms 42 to be released from their retracted positions. In this regard, it should also be noted that the flange portions 39 of one of the slider members 32 includes a recess 38 in order to allow clearance for the opposite ends of the anchoring pins 47 when the support arms 42 are moved to their retracted positions.

In order to releasably interlock and maintain the slider assemblies 30, the support arm assemblies 40, and the signs 14 in their respective preselected display positions, the track base plate 25 includes an opening 27, shown in FIG. 4, which operatively cooperates with the locking apparatus 50. The locking apparatus 50 preferably includes a resilient locking member 52, or alternatively a locking member that is resiliently biased inwardly, with an inwardly-protruding protuberance 54 adapted to be interlockingly received within the opening 27. As the slider assembly 30 is raised within the channels 24 to the preselected display position, a pin or other such member 29 fixedly secured to the legs 26 of the channels 24 engages the locking member 52 in order to urge the protuberance 54 inwardly into the opening 27. Because the preferred locking member 52 is composed of a resilient material, the locking apparatus 50 can be released for purposes of lowering the slider assembly 30 in the track assembly 20 by way of a tab 56 for deflecting the locking member 52 downwardly to clear the pin member 29, thereby allowing the protuberance 54 to be retracted out of the opening 27 in the channel legs 26.

The signs 14 are preferably provided with sleeve portions 17, each having one or more openings 18 therein, as shown in FIG. 5. In order to attach the signs 14 to their respective support arms 42, the support arms 42 are slidably inserted into the sleeve portions 17. The support arms 42 are preferably provided with spring-loaded tabs or buttons 49 that protrude through openings 43 in the support arms 42 and are resiliently biased in an outward direction. The tabs 49 can be urged inwardly to allow the support arms 42 to be slidably inserted into the sleeve portions 17 of the signs 14 until the signs 14 are properly located on the support arms 42, and the tabs 49 can be released to protrude through the openings 18 in the sleeve portion 17, thereby removably securing the signs 14 on the support arm assemblies 40. Furthermore, in order to facilitate and guide the sliding insertion of the support arms 42 in the sleeve portions 17 of the signs 14, the support arms 42 are preferably provided with guide plugs 60, as shown in FIG. 5, which are preferably forcibly inserted and frictionally retained in the open, free ends of the support arms 42. In order to accomplish this effect, the guide plugs 60 are preferred provided with an arcuate or radiused configuration.

An alternate embodiment of the present invention, is shown in FIGS. 6 through 10, and includes an alternate sign-supporting device 110. The sign-supporting device 110 generally includes an elongated track member 112, a sign or banner 114, a slider member 118, a pair of cantilever mounted support arms 120, and two pairs of locking finger brackets 122.

As with the preferred embodiment shown in FIGS. 1 through 9, sign-supporting device 110 is adapted to be mounted on a pole or column 124, as depicted in the drawing, but it is understood that the invention can be mounted or positioned on a wall or any other type of surface. In addition, the pole 124 can have any of a number of cross-sectional size and shape. Furthermore, as with the embodiment shown in FIGS. 1 through 5, two sign-supporting assemblies 110 and 110' can be mounted on the same pole 124. In the same manner, as with the preferred embodiment shown in FIGS. 1 through 5, one skilled in the art will readily recognize that virtually any number of such assemblies can also be mounted around the periphery of a pole or column or along the surface of a wall, using the present invention.

The track member 112 can be secured to the pole 124 in any conventional manner, as mentioned above, such as by clamps, brackets, screws, bolts or the like. As shown in the drawings, the track members 112 are clampingly affixed to the pole by strap or band-type clamp members 130. The clamp members are passed through openings 132 in the track members 112 and securely held in place in a manner similar to that discussed above in connection with the preferred embodiment.

Figure 7:
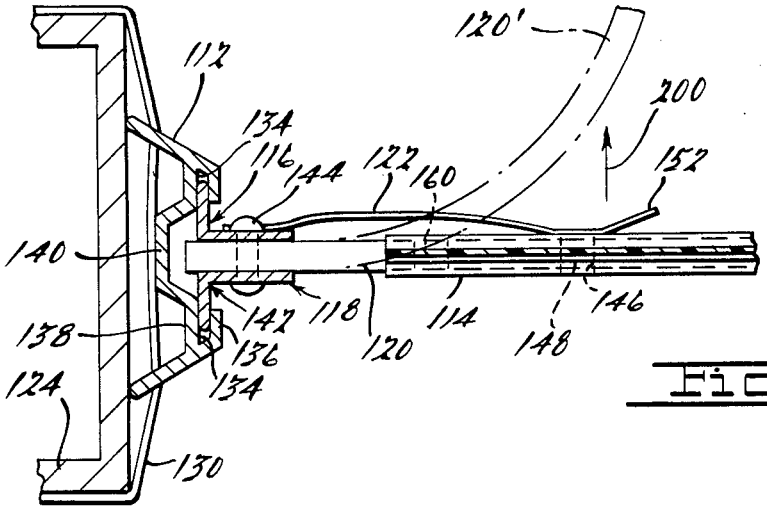
FIG. 7 is a partial cross-sectional view taken generally along line 7—7 of FIG. 6.
Figure 8:
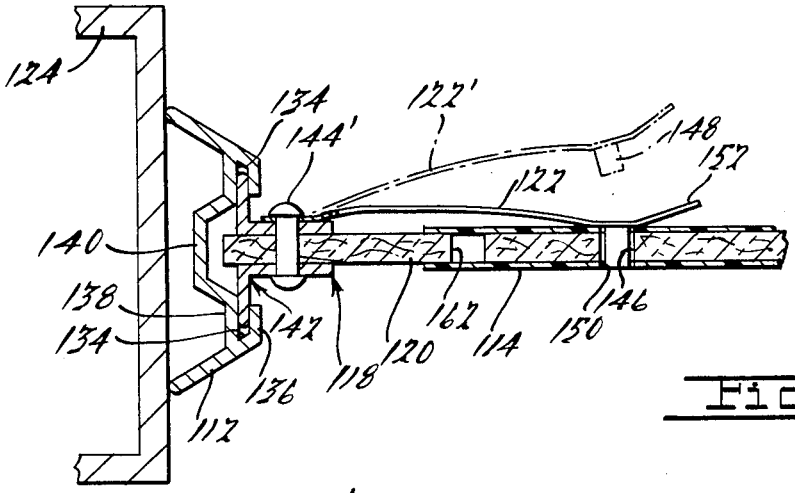
FIG. 8 is a cross-sectional view taken generally along line 8—8 of FIG. 6.

The track 112 has a cross-section as seen in FIGS. 7 and 8, and generally includes a pair of channels 134 in which the slider member 118 is slidably positioned. The channels 134 are formed between a pair of legs 136 and 138. The legs 136 and 138 are substantially parallel to one another along the full length of the track members 112. In addition, the leg 138 has an indented base plate portion 140 which provides clearance for the sign mechanism when the support arms 120 are rotated to their closed positions (**120*a***).

As indicated above, the sign-supporting assembly 110 includes a slider member 118, a pair of support arms 120, and one or more locking brackets 122. The slider member 118 is generally formed from a pair of elongated L-shaped support members 142, as best seen in FIGS. 7 and 8. The L-shaped members 142 are slidably positioned in the channels 134 and in the track member 112 and are held together by a group of conventional fasteners 114, such as rivets, nuts and bolts, screws or the like. The support arms 120 and locking brackets 122 are also pivotally secured to the slide members 118 by one or more of the fasteners 144.

Figures 6, 9:
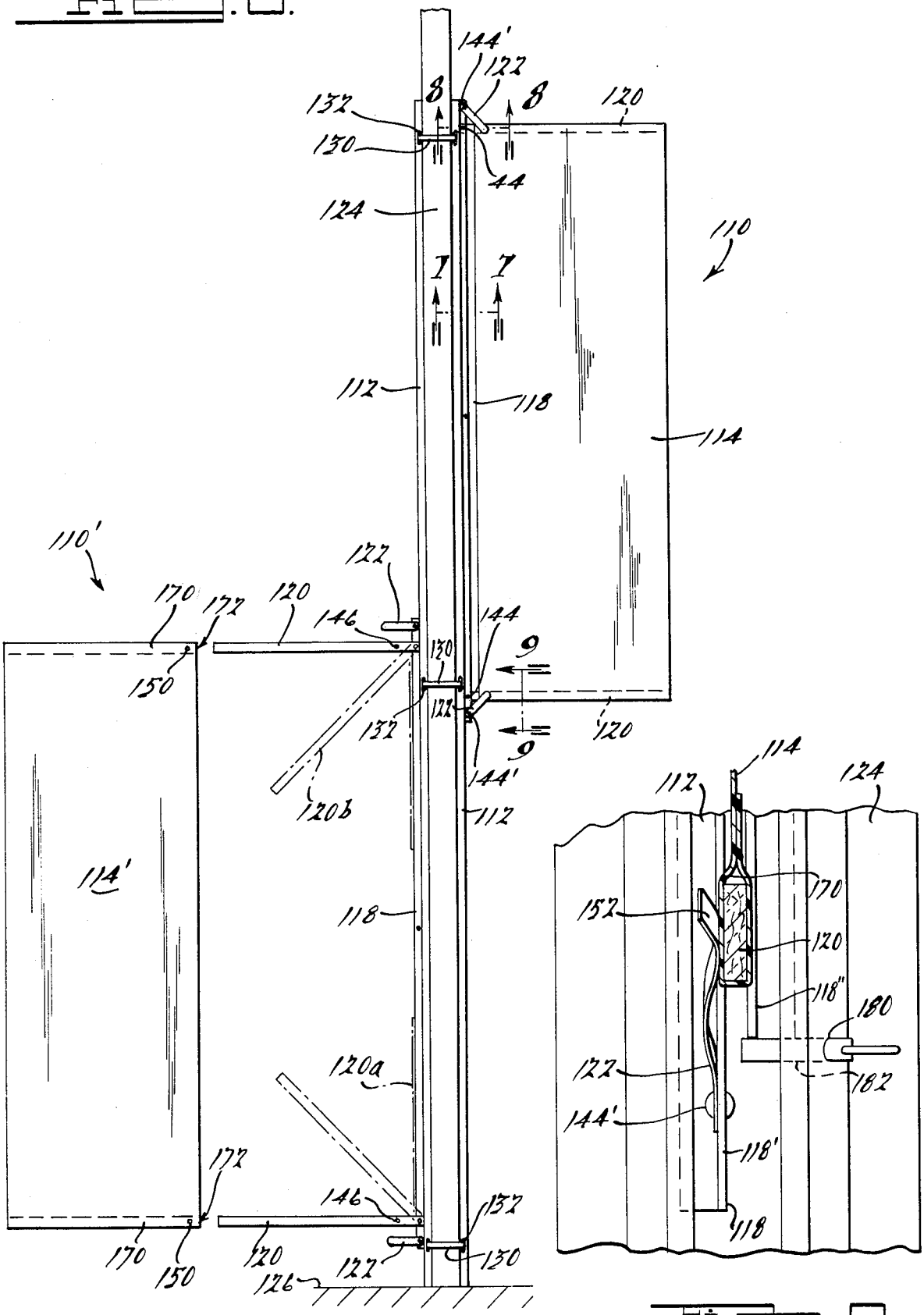
FIG. 6 is a front elevational view of another embodiment of a sign and sign-supporting device in accordance with the present invention.
FIG. 9 is a cross-sectional view taken generally along line 9—9 of FIG. 6.
Figure 10:
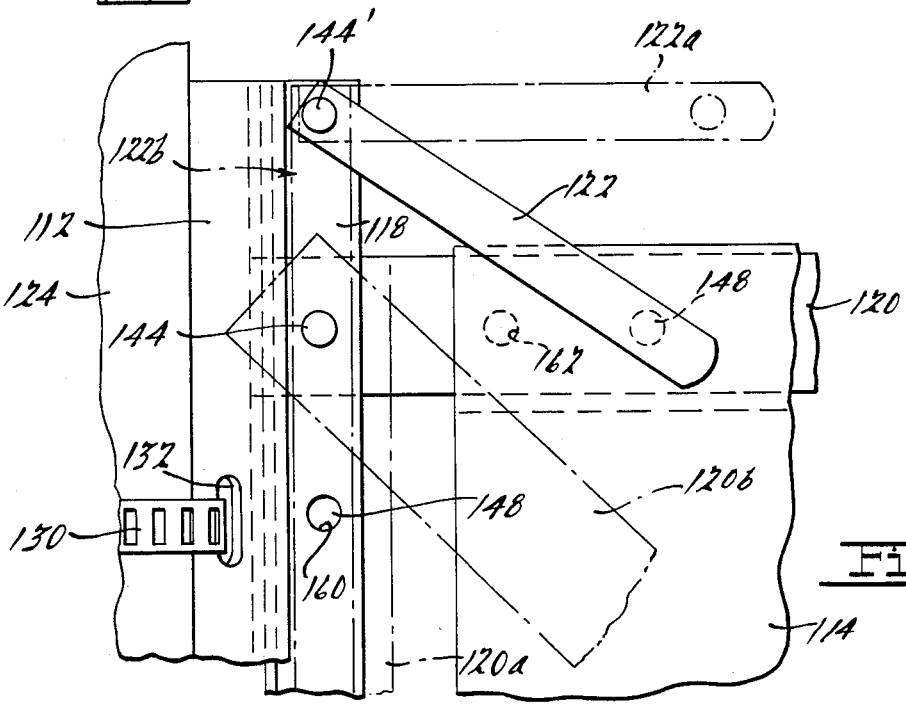
FIG. 10 is an enlarged, partial side elevational view of a portion of the sign-supporting device of FIG. 6.

The support arms 120 are preferably flexible, elongated members and are positioned in a cantilever manner on the slider member 118. Preferably, the arms 120 are manufactured from a fiber-resin material, such as fiberglass. The support arms 120 pivot, as best seen in FIGS. 6 and 10, from a closed position (**120*a*) to an open position (120). For illustrative purposes, the support arms are also shown in the drawings in an intermediate position (120*b*) in phantom lines between the open and closed positions. The support arms 120 fit between, and are substantially concealed by, the L-shaped members 142 when the arms 120 are in their closed or storage positions (120*a*). The arms 120 have at least one or more apertures 146 for retaining the locking brackets 122 in place. The arms 120 can be made interchangeable so that longer or shorter arms may be substituted for holding larger or smaller signs 114 by way of removable pivot fasteners 144**.

The preferred fiberglass construction of the arms 120 provides the support assembly 116 with flexible and lightweight characteristics. The fiberglass construction enables the support assembly 116 to bend in the face of winds without any adverse effects on the sign support assembly or sign assembly mechanism. When wind forces 200 or other forces are exerted on the assembly 116, the support arms 120 deflect (as shown in phantom lines 120' in FIG. 7) reducing the overall wind resistance of the sign-supporting assembly 110. It is also preferable to include a metal or plastic stiffening support or sleeve (not shown) at the inner end of each of the support arms 120 to insure that they will not crack or break during high winds or severe deflection of the sign assembly.

The track members 112 and remainder of the slide assembly 116 preferably are made of durable, weather-resistant material, such as steel or extruded aluminum.

The locking brackets 122 are elongated members preferably manufactured from a resilient metallic material, such as spring steel. One of the locking brackets 122 in each pair has a nob or detent 148 which fits into hole 146 in the support arms 120 for securing the arms substantially perpendicular to the slide member 118 in their open position. The other locking bracket 123 is positioned on the opposite side of support arm 120 and has a hole 149 for mating with the end of the nob or detent 148. The sign banner 114 also is provided one or more holes 150 which align with hole 146. The locking brackets 122 and 123 provide spring forces against arm 120 on both sides thereby holding the banner sign 114 and support arm 120 securely in place. The brackets 122 and 123 also have curved or bent outer ends 152 which allow them to be grasped and manipulated manually (as illustrated in phanton lines 122' and 123' in FIG. 8).

As best shown in FIG. 10, the locking brackets 122 and 123 are rotatable around a pivot pin 144'. When the brackets are used to hold the supporting arms and banner sign in place, they are situated as shown in FIG. 10 using bracket 122 for reference. If desired, it is also possible to rotate the brackets away from the support arms 120 (as shown by position **122*a* for bracket 122, with the movement of bracket 123 being similar). This allows for ease of movement of the support dims 120 as well as ease of removal or replacement of the banner sign 114. For storage, the locking brackets 122 and 123 can be rotated to position 122*b* which is parallel to the slide member 118 and track member 112. In the latter position (122*b*), the nub or detent 148 is positioned in groove or hole 160 in the slide member 118. Preferably, the hole 160 extends all the way through the slide member 118 so that when the locking bracket 122 is in its storage position (122*b*) the nob or detent 148 will contact support arm 120 in its closed or stored position (120*a*) and hold it in place. In addition, the support arm 120 can be provided with an additional hole 162 for securely mating with nob 148** in the storage position.

The above discussion has been particularly directed to the upper right-hand locking brackets 122 and 123 as viewed in FIG. 5. It is understood, however, that all of the other pairs of locking brackets shown in the drawings and used with the inventive sign assembly mechanism can be and preferably are similar in structure and operation. Thus, each pair of locking brackets is not discussed separately. Also, it is possible to use just one locking bracket 122 to hold and support arm 120 and sign 114, as shown in FIG. 9. Similarly, all of the support arms 120 shown in the drawings for each sign assembly mechanism preferably have the same composition, structure, characteristics and operation and thus are not described separately.

The sign 114, as seen in FIG. 6, is preferably a banner-type sign constructed from a soft, flexible woven or non-woven material, as is the sign 14 of FIGS. 1 through 5. However, it is understood that metallic, resin-glass or other rigid but bendable sheet materials may be used in accordance with the scope of the present invention. The sign 114 has at least one or more sleeves or tubular members 170 for enabling the sign 114 to be positioned on the arms 120 of the sign-supporting assembly 110. The sleeves 170 are formed on the two opposite ends of the sign 114. When woven or non-woven materials are used, the sleeves are formed by rolling over the end of the sign material and securing it to itself, e.g., by stitching, gluing or the like. The sleeves 170 have at least one open end 172 so that they can be slid over the support arms 120. The arms 120 are slid through the open end 172 into the sleeves 170 until the sign 114 reaches its desired position and the opening 150 in the sign is aligned with the opening 146 in the arm 120.

The sign 114 is preferably mounted on the arms 120 of the sign-supporting assembly 110 when the assembly 116 is on the pole 112 in a position closest to the ground 126, as seen in FIG. 6 (left-hand side). If the support arms 120 and locking brackets 122 are initially in their storage positions (120*a* and 122*a*), then they are rotated to the open and unlocked positions shown in FIG. 6 (left-hand side) for receipt of a banner sign 114. If a sign 114 is being replaced, the locking brackets 122 are relased from the holes 146 and 150 and the old sign 114 is slid off the support arms. Once a new sign is positioned on the support arms, the locking brackets 122 are secured in place by holding the arms 120 fully extended and the sign 114 onto the arms.

After the sign 114 is installed on the sign-supporting assembly 110, the entire assembly is raised vertically in the elongated track member 112 to its desired position above the ground 126. This is shown in FIG. 6 (right-hand side). The sign-supporting assembly 110 is held in its raised position by a stop pin 180 which is inserted in an opening or hole 182 in the track member 112. The pin 180 can be a hitch pin or any type of elongated rod. The pin 180 can extend through the track member 112 and be positioned in the path of the slide members 118. Alternately (as shown in FIG. 9), the pin 180 can be positioned through one of the two halves of the track member so that it will not be visible from one side of the sign assembly mechanism. For this purpose, one of the slide members 118' is longer than the other slide member 118" (FIG. 9) in order to hide one end of the pin 180. If desired, the pin 180 also could be adapted to fit through a hole or opening in the slide member 118 to hold it in place (not shown).

When the pin 180 is removed, the slide member 118 can be lowered to ground level for removal or replacement of the sign. For security reasons, such as to prevent theft or unauthorized removal of the sign, a conventional lock (key or combination may be substituted for the pin 180. It is also preferred to have another pin or stop member (not shown) positioned on the top of the track member 118 so that the sign-supporting assembly 110 cannot be raised beyond the upper end of the track member.

If it is desired to situate the banner sign 114 at various heights above the ground, several holes or sets of openings could be provided in the track member 118 along the length thereof. In this manner, the pin 180 (or lock) could be inserted at various positions, thereby holding the sign at various heights.

In another embodiment of the invention, it is possible to use "stops" on the track mechanism to hold the support arms in position and prevent them from collapsing into storage postions during use.

The foregoing discussion describes and discloses exemplary embodiments of the present invention. One skilled in the art will readily recognize from such discussion, and from the accompanying drawings and claims, that various changes, modifications and variations may be made therein without departing from the spirit and scope of the invention as defined in the following claims.

I claim:

1. A sign-supporting device for supporting and displaying a sign at a preselected display position on a surface of an object, said sign-supporting device comprising:

a track including a pair of opposed elongated channels spaced laterally apart from one another, and a track discontinuity on said track;

track mounting means for securing said track to the surface of the object;

at least one slider having an inner base disposed at an inner position between said elongated channels and an outer flange portion protruding outwardly generally away from said inner base and said track, said innerbase being received within said opposed elongated channels for sliding movement therein in a longitudinal direction along said track, said inner base further having an opening therein;

a support arm for supporting the sign thereon, said support arm having an inner end and being interconnected with said slider for sliding movement therewith relative to said track to and from the preselected display position, said support arm being pivotally interconnected with said outer flange portion of said slider for pivotal movement relative thereto between an extended position protruding generally transversely away from said track and a retracted position oriented generally longitudinally adjacent said channels said support arm further being movably interconnected with said outer flange portion of said slider for limited movement toward and away from said pivotal interconnection therewith, said inner end of said support arm being receivable within said opening in said inner base when said support arm is in said extended position and is moved toward said pivotal interconnection in order to retain said support arm in said extended position, said support arm being removed from said opening in an inner base when said support arm is moved away from said pivotal interconnection in order to allow said pivotal movement between said extended and retracted positions; and a locking member interconnected with said slider, said locking member being interlockingly and selectively releasably engageable with said track discontinuity on said track when said slider and said support arm are slidably moved to the preselected display position in order to releasably secure said slider and said support arm in said preselected display position.

2. A sign-supporting device according to claim 1, wherein said track further includes means for releasably urging said locking member into said interlocking engagement with said track discontinuity on said track when said slider, said support arm, and said locking member are moved relatively to said track to the preselected display position.

3. A sign-supporting device according to claim 1, wherein said locking member includes resilient biasing means for resiliently biasing a portion of said locking member toward said track.

4. A sign-supporting device according to claim 1, wherein said inner end of said support arm is chamfered in order to facilitate the movement and receipt of said inner end of said supporting arm into said opening in said inner base when said support arm is pivoted to said extended position.

5. A sign-supporting device according to claim 1, further including attachment means for removably attaching the sign to the support arm.

6. A sign-supporting device according to claim 5, wherein said slider, said support arm, and said locking member are removably interconnected as an assembly with said channels in order to allow the sign to be selectively attached to and removed from said support arm apart from the track.

7. A sign-supporting device according to claim 1, wherein said track discontinuity includes means defining a track opening in said track, said locking member including a protuberance thereon interlockingly and releasably receivable in said track opening when said slider, said locking member, and said support arm are slidably moved to said preselected display configuration.

8. A sign-supporting device according to claim 7, further including means for urging said protuberance on said locking member into said interlocking engagement with said track opening when said slider, said locking member, and said support arm are slidably moved to said preselected display configuration.

9. A sign-supporting device according to claim 1, wherein said slider includes a slider flange discontinuity in said outer flange portion, said support arm being interlockingly and selectively releasably engageable with said slider flange discontinuity when said support arm is pivoted to said retracted position.

10. A sign-supporting device according to claim 9, wherein said slider flange discontinuity includes means defining a slider flange opening in said outer flange portion, said support arm having at least one protuberance thereon interlockingly and releasably engageable with said slider flange opening when said support arm is pivoted to said retracted position.

11. A sign-supporting device according to claim 10, further including a pivot pin extending through said support arm and fixed to said outer flange portion of said slider for pivotally interconnecting said support arm with said slider, said pivot pin being received within an elongated opening in said support arm in order to allow limited movement of said support arm toward and away from said pivot pin, said support arm further including resilient arm biasing means for resiliently biasing said support arm inwardly toward said pivot pin, said outer flange portion of said slider including a cam portion extending into said slider flange opening from a laterally outer portion thereof, said cam portion urging said support arm to move generally away from said pivot pin when said protuberance slidably engages said cam portion as said support arm is moved to and away from said retracted position, said resilient arm biasing means urging said support arm toward said pivot pin when said protuberance is out of engagement with said cam portion.

12. A sign-supporting device according to claim 11, wherein said cam portion releasably maintains said support arm in a substantially concealed position adjacent said outer flange portion when said support arm is pivoted to said retracted position with said protuberance received within said slider flange opening at a position inward of said cam portion.

13. A sign-supporting device according to claim 1, wherein said support arm is of an elongated configuration having a free outer end opposite said inner end, and wherein the sign includes a sleeve portion thereon for receiving said elongated support arm slidably inserted therein, said support arm including guide means generally at said free outer end for guiding said support arm when support arm is slidably inserted into said sleeve portion of the sign, said guide means being generally of a radiused configuration in order to facilitate said slidable insertion of said support arm into said sleeve portion.

14. A sign-supporting device according to claim 13, wherein said elongated support arm is of a generally hollow tubular configuration with said free outer end being substantially open, said guide means comprising a radiused plug inserted into said open free outer end.

15. A sign-supporting device according to claim 1, wherein the object comprises a generally vertical pole, said sign supporting device being adapted for supporting and displaying the sign at a preselected elevated display position.

16. A sign-supporting device according to claim 15, wherein a pair of said sign support devices are disposed on different sides of said pole for independently supporting and displaying a pair of signs.

17. A sign-supporting device for supporting and displaying a sign at a preselected display position on a surface of an object, said sign-supporting device comprising:

a track including a pair of opposed elongated channels spaced laterally apart from one another, and a track discontinuity on said track;

track mounting means for securing said track to the surface of the object;

at least one slider received within said opposed elongated channels for sliding movement therein in a longitudinal direction along said track, said slider including a slider discontinuity defining a slider opening therein;

a support arm for supporting the sign thereon, said support arm being interconnected with said slider for sliding movement therewith relative to said track to and from the preselected display position, said support arm being pivotally interconnected with said slider for pivotal movement relative thereto between an extended position protruding generally transversely away from said track and a retracted position oriented generally longitudinally adjacent said channels, said support arm having at least one protuberance thereon interlockingly and selectively releasably engageable with said slider opening when said support arm is pivoted to said retracted position;

a pivot pin extending through said support arm and fixed to said slider for pivotally interconnecting said support arm with said slider, said pivot pin being received within an elongated opening in said support arm in order to allow limited movement of said support arm toward and away from said pivot pin, said support arm further including resilient arm biasing means for resiliently biasing said support arm inwardly toward said pivot pin, said slider including a cam portion extending into said slider opening from a laterally outer portion thereof, said cam portion urging said support arm to move generally away from said pivot pin when said protuberance slidably engages said cam portion as said support arm is moved to and away from said retracted position, said resilient arm biasing means urging said support arm toward said pivot pin when said protuberance is out of engagement with said cam portion; and a locking member interconnected with said slider, said locking member being interlockingly and selectively releasably engageable with said track discontinuity on said track when said slider and said support arm are slidably moved to the preselected display position in order to releasably secure said slider and said support arm in said preselected display position.

18. A sign-supporting device according to claim 17, wherein said slider includes at least one flange portion protruding laterally outwardly therefrom, said slider opening and said cam portion being formed in said flange portion, said cam portion releasably maintaining said support arm in a substantially concealed position adjacent said flange portion when said support arm is pivoted to said retracted position with said protuberance received within said slider opening at a position inward of said cam portion.

* * * * *

UNITED STATES PATENT AND TRADEMARK OFFICE

CERTIFICATE OF CORRECTION

PATENT NO. : 4,730,803

DATED : March 15, 1988

INVENTOR(S) : David U. Hillstrom

It is certified that error appears in the above-identified patent and that said Letters Patent is hereby corrected as shown below:

| | | |
|---|---|---|
| Column 1, | line 30, | "t a" should be --at--. |
| Column 1, | line 50, | insert "display" after --preselected--. |
| Column 2, | lines 62-63, | "clamping" should be --clampingly--. |
| Column 3, | line 48, | delete "and". |
| Column 6, | line 50, | "dims" should be --arms--. |
| Column 7, | line 67, | insert ")" after --combination--. |
| Column 9, | line 11, | "relatively" should be --relative--. |

Signed and Sealed this

Sixth Day of September, 1988

*Attest:*

*Attesting Officer*

DONALD J. QUIGG

*Commissioner of Patents and Trademarks*